US006354808B1

(12) United States Patent
Shenoi et al.

(10) Patent No.: US 6,354,808 B1
(45) Date of Patent: Mar. 12, 2002

(54) MODULAR LIQUID RING VACUUM PUMPS AND COMPRESSORS

(75) Inventors: Ramesh B. Shenoi, West Orangeburg, NY (US); Carl G. Dudeck, Newtown, CT (US)

(73) Assignee: The Nash Engineering Company, Trumbull, CT (US)

( * ) Notice: Subject to any disclaimer, the term of this patent is extended or adjusted under 35 U.S.C. 154(b) by 0 days.

(21) Appl. No.: 09/546,224

(22) Filed: Apr. 10, 2000

Related U.S. Application Data

(60) Provisional application No. 60/186,263, filed on Mar. 1, 2000.

(51) Int. Cl.[7] ..... F04C 19/00
(52) U.S. Cl. ..... 417/68
(58) Field of Search ..... 417/68

(56) References Cited

U.S. PATENT DOCUMENTS 4,613,283 A * 9/1986 Haavik ..... 417/68
D294,266 S 2/1988 Dudeck et al. ..... D15/7
4,850,808 A 7/1989 Schultze et al. ..... 417/68
5,073,089 A * 12/1991 Trimborn ..... 417/68
5,217,352 A * 6/1993 Haavik ..... 417/68
5,370,502 A * 12/1994 Haavik et al. ..... 417/68
5,899,668 A * 5/1999 Shenoi et al. ..... 417/68
5,961,295 A * 10/1999 Haavik et al. ..... 417/68

* cited by examiner

*Primary Examiner*—Joseph Pelham
*Assistant Examiner*—Vinod D. Patel
(74) *Attorney, Agent, or Firm*—Fish & Neave; Robert R. Jackson; James A. Leiz

(57) ABSTRACT

Liquid ring pumps, of the type having a port structure that extends into an annular recess in an end of the rotor, have several parts that are designed so that they can be used to make pumps having either relatively demanding service requirements or substantially less demanding service requirements. Some of these parts can be substantially exactly the same in both final pump configurations. Others of these parts may be castings that differ substantially only in some subsequent machining in order to adapt them for each final pump configuration. Some of the final pump configurations have more compact mechanical seal structures and/or improved structures for supplying liquid to the seal structures.

20 Claims, 4 Drawing Sheets

MODULAR LIQUID RING VACUUM PUMPS AND COMPRESSORS

This application claims the benefit of provisional patent application No. 60/186,263, filed Mar. 1, 2000, which is hereby incorporated by reference herein in its entirety.

BACKGROUND OF THE INVENTION

This invention relates to liquid ring vacuum pumps and compressors, and more particularly to constructions for such products which increase the number of parts that can be used in more than one product configuration. For ease of reference, the term "pump" or "pumps" is generally used herein as a generic term for both pumps and compressors.

Liquid ring pumps are typically designed so that a single pump design can serve a number of markets. Accordingly, the same basic pump may be used for different applications such as chemical processing, general industrial markets, and so on. Generally, chemical and petrochemical process applications require higher discharge and hydrostatic test pressure (i.e., liquid leakage pressure) capabilities and the use of special mechanical seals. These requirements are often not so stringent in general industrial applications. For example, in the chemical processing industry differential pressures to 30 psig and hydrostatic test pressures to 225 psig are common requirements. In comparison, for general industrial pumps the differential pressure capability required is typically about 15 psig and hydrostatic test is about 75 psig. Also, chemical industry pumps may have to meet certain industry specifications such as those set by the American Petroleum Institute or the Engineering Equipment and Materials Users Association.

Because a liquid ring pump may be needed for any of these markets, overall design is often based on meeting specifications for the more demanding chemical process applications. The resulting design is "optimal" for chemical applications, but may be "over-designed" for general industrial applications. Pumps of the type shown in Dudeck et al. U.S. Pat. No. Des. 294,266 (also known as the "SC" type of pump available from The Nash Engineering Company of Trumbull, Connecticut) are an example of this type of known pump design. To meet the more stringent requirements of chemical process applications, these pumps have removable bearing brackets to facilitate access to the mechanical seals. The seals are also provided with an external flush to cool the seal and help reduce erosive damage to the seal components. Features such as these are often not necessary for less demanding general industrial applications. Accordingly, the SC design may be a more costly one than is needed for such less demanding installations. On the other hand, it is also costly to provide completely separate designs that have been optimized for each possible application.

(It should be noted here that the SC pumps also use gas scavenging technology of the type shown in Schultze et al. U.S. Pat. No. 4,850,808, which is hereby incorporated by reference herein in its entirety.)

In view of the foregoing, it is an object of this invention to provide liquid ring pumps that can economically meet the requirements of several different types of service without all parts of the pump having to be entirely customized to each type of service.

It is another object of this invention to provide simplified lubrication of seals which can be used in at least some liquid ring pumps.

SUMMARY OF THE INVENTION

These and other objects of the invention are accomplished in accordance with the principles of the invention by providing liquid ring pumps having at least several major components that can be used or easily adapted for use in pumps having either of at least two significantly different designs, each of which is adapted to meet a respective one of two significantly different sets of service requirements. For example, although two different pumps may have such variations as different shaft diameter and shaft length between bearings, the two pumps may have several common rough parts such as the rotor, head, cone, and lobe, and may have common finished parts such as the lobe. To accomplish this in the case of the head, for example, that part may be cast with sufficient material in the shaft area so that this material can be machined out either for a relatively large shaft (for a higher pressure pump) or for a relatively small shaft plus a bearing (for a lower pressure pump). Similarly, in the case of the cone, that part may be cast with enough material in the shaft area so that it may be machined out either for the larger shaft or for a relatively small shaft plus mechanical seal components.

The pumps of this invention may also be constructed with features that simplify the provision and lubrication of seals, especially for pumps with less stringent seal requirements. For example, at one end of the pump the seals may be located inside the cone of the pump where they can be lubricated by the flow through the above-mentioned gas scavenging structure associated with the cone. At the other end of the pump, the rotor shroud may be perforated to facilitate a flow of liquid from the liquid ring to and past the seals at that end.

Further features of the invention, its nature and various advantages will be more apparent from the accompanying drawings and the following detailed description of the preferred embodiments.

DETAILED DESCRIPTION OF THE PREFERRED EMBODIMENTS

Figure 1:
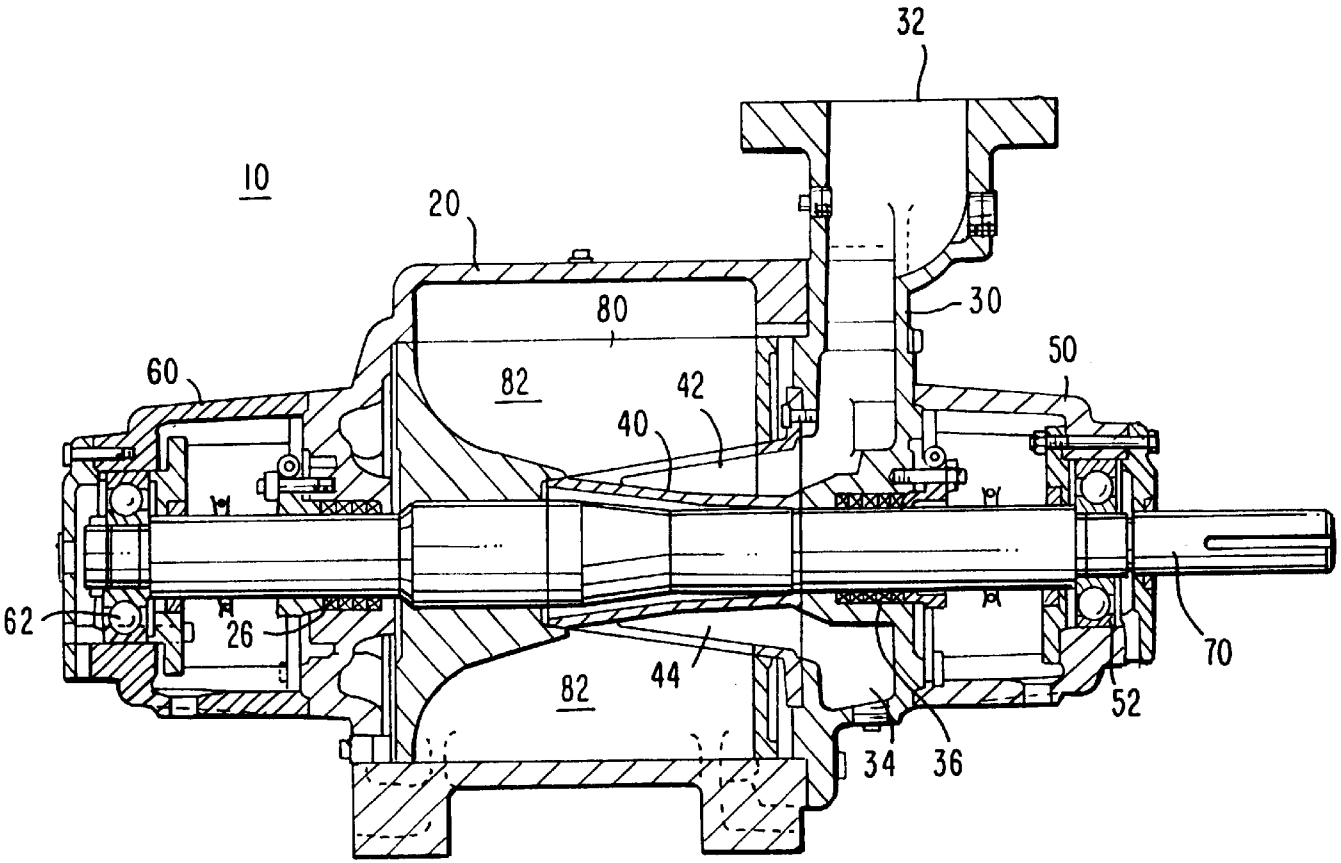
FIG. 1 (PRIOR ART)
FIG. 1 is a simplified sectional view of an illustrative prior art liquid ring pump.

The typical prior art liquid ring pump 10 shown in FIG. 1 includes the following principal parts: stationary housing (or lobe) 20; stationary head 30 attached to one axial end of lobe 20; stationary cone (or port member) 40 mounted on head 30 and projecting into the interior of lobe 20; stationary bearing bracket 50 also mounted on head 30; stationary bearing bracket 60 mounted on the end of lobe 20 remote from head 30; shaft 70 rotatably mounted in bearings 52 and 62 in bearing brackets 50 and 60, respectively; and rotor 80 mounted on shaft 70 for rotation therewith. As is conventional for liquid ring pumps, lobe 20 is eccentric to shaft 70 and contains a quantity of liquid (e.g., water) which the radially and axially extending blades 82 of rotor 80 form into a recirculating ring of liquid inside lobe 20. On one circumferential side of pump 10 the inner surface of this liquid ring is moving radially out away from the central longitudinal axis of shaft 70. Accordingly, on this side of the pump gas is pulled into the spaces between circumferentially adjacent rotor blades 82 via gas intake passages 32 and 42 in head 30 and cone 40, respectively. On the other circumferential side of the pump the inner surface of the liquid ring is moving radially in toward the central longitudinal axis of shaft 70. Accordingly, on this side of the pump gas is compressed between circumferentially adjacent rotor blades 82 and then discharged from the pump via discharge passages 44 and 34 in cone 40 and head 30, respectively. (The connection of discharge passage 34 to the exterior is not visible in FIG. 1, but such a connection is nevertheless present in pump 10.)

A stuffing box 36 is provided in head 30 around shaft 70 to accommodate packing or mechanical seals. Another similar stuffing box 26 is provided in lobe 20 around shaft 70, again to accommodate packing or mechanical seals. (FIG. 1 actually shows packing in both stuffing boxes 26 and 36.) Bearing brackets 50 and 60 are removable to facilitate maintenance of the packing or mechanical seals in boxes 26 and 36. External liquid couplings (not shown) are provided to provide liquid to the packing or mechanical seals for such purposes as lubrication, cooling, contaminant flushing, etc.

With the various features that have thus been described, pump 10 is able to meet very stringent service requirements such as those that are often encountered in chemical processing.

Figure 2:
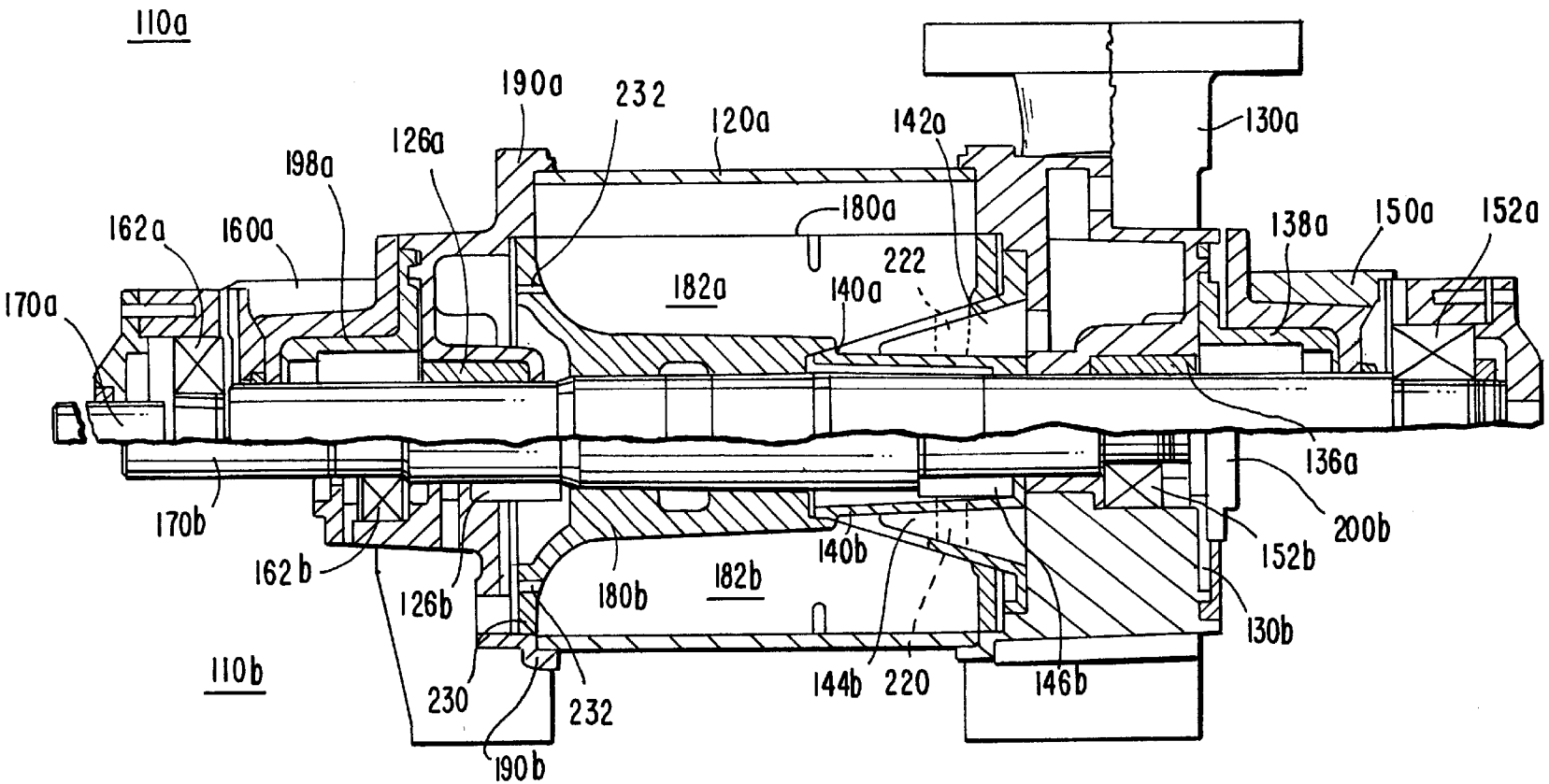
FIG. 2 a simplified, composite, sectional view of portions of two different final pump constructions that can be made using several common or substantially common parts in accordance with the invention. In particular, the upper portion of FIG. 2 shows one of these two final pump constructions, and the lower portion of FIG. 2 shows the other of these two final pump constructions.

FIG. 2 shows representative portions of two different pumps that can be constructed using several substantially common parts in accordance with this invention. Above the chain-dotted shaft centerline FIG. 2 shows a portion of a pump 110*a* which is designed to meet relatively stringent service requirements like those met by pump 10 in FIG. 1. Below the chain-dotted shaft centerline FIG. 2 shows a portion of a pump 110*b* which is designed to meet less stringent service requirements. (The drive ends of the shafts in FIG. 2 are on the left rather than on the right as shown in FIG. 1.) Parts in FIG. 2 that are generally similar to parts in FIG. 1 have reference numbers that are increased by 100 from the reference numbers for the corresponding parts in FIG. 1. (Although FIG. 1 suggests that the left-hand end of lobe 20 is closed by structure that is integral with the remainder of the lobe, FIG. 2 shows use of a separate end plate 190*a*/*b* for that purpose.) Also in FIG. 2, parts of pump 110*a* all have reference numbers with the suffix "a", and parts of pump 110*b* all have reference numbers with suffix "b". Although a part may thus be shown in FIG. 2 with both suffix "a" and suffix "b", that part may in fact be one common part (e.g., a common casting with common machining), or one substantially common part (e.g., a common casting with only somewhat different machining). Particular examples of this commonality of parts will be discussed in more detail below.

Principal differences between pumps 110*a* and 110*b* in FIG. 2 are as follows: Shaft 170*a* is both longer between bearings 162*a* and 152*a* and larger in diameter than shaft 170*b*. A more robust shaft is used in pump 110*a* because the distance between bearings 162*a* and 152*a* is greater and because pump 110*a* is designed for greater pressure. Pump 110*a* has a greater distance between bearings 162*a* and 152*a* for the same reason that pump 10 has a comparable distance between bearings, namely, to allow more room for more elaborate stuffing boxes and mechanical seals, and to facilitate access to those elements. Pump 110*b*, on the other hand, can have its bearings 162*b* and 152*b* closer together because pump 110*b* does not need such elaborate stuffing boxes and mechanical seals. Because bearings 162*b* and 152*b* are closer together (and because pump 110*b* is designed for lower pressures), shaft 110*b* can be both shorter and smaller in diameter. At the right-hand end of pump 110*b* bearing 152*b* can be disposed directly in head 130*b* and no projecting bearing bracket comparable to bracket 150*a* is needed at all. In addition, mechanical seal 146*b* can be located inside cone 140*b* in lieu of stuffing boxes 136*a* in head 130*a* and an additional mechanical seal retainer 138*a* mounted on the outside of head 130*a* inside of bearing bracket 150*a*. Similarly, at the left-hand end of pump 110*b*, bearing 162*b* can be disposed in end plate 190*b*. Mechanical seal 126*b* can be relatively close to the shrouded end of rotor 180*b*. This is in contrast to the provision in pump 110*a* of more elaborate stuffing box 126*a* and bearing bracket 160*a* and mechanical seal retainer 198*a* mounted on the outside of end plate 190*a*.

The pump constructions shown in FIG. 2 allow commonality of major components as follows: The same rough parts (e.g., the same castings) can be used for rotors 180*a* and *b*, heads 130*a* and *b*, cones 140*a* and *b*, and lobes 120*a* and *b*. The same finished parts (e.g., machined castings) can be used for lobes 120*a* and *b*. For example, a generic rotor casting 180 can be made with a sufficiently small shaft opening that it can be machined out either by the relatively small amount required to accept relatively small diameter shaft 170*b* or by the relatively large amount required to accept relatively large diameter shaft 170*a*. Similarly, a generic head casting 130 can be made with a sufficient quantity of metal surrounding the central shaft opening so that this metal can be machined out either to receive relatively large diameter shaft 170*a* and to form stuffing box 136*a* or to receive relatively small diameter shaft 170*b* plus bearing 152*b*. In either case sufficient head metal remains to completely annularly surround elements 170*a* and 136*a* or elements 170*b* and 152*b*. However, not so much metal is provided in that part of generic head 130 that adequate gas intake and discharge passages (comparable to passages 32 and 34 in FIG. 1) are not also provided in head 130. Generic head 130 is also configured to receive either bearing bracket 150*a* and mechanical seal retainer 138*a* or a much simpler end plate 200*b*. As yet another example, a generic cone casting 140 can be made with sufficient material in the shaft area so that this material can be machined out to receive either relatively large diameter shaft 170*a* or relatively small shaft 170*b* plus mechanical seal 146*b*.

Common finished parts are possible for lobes 120*a* and *b*.

Examples of principal parts that are not common between pumps 110*a* and 110*b* include shafts 170*a* and 170*b*, left-hand end plates 190*a* and 190*b*, and the more elaborate bearing brackets 150*a* and 150*b* that have to be provided for pump 110*a*. Nevertheless, the ability to construct pumps 110*a* and 110*b* with several principal parts that are common or substantially common is a great cost saving for both pump configurations.

FIG. 2 also illustrates other features of the invention which will now be described. As was mentioned earlier, pumps 110*a* and 110*b* may be constructed with gas scavenging like that shown in Schultze et al. U.S. Pat. No. 4,850,808. A passage 220 is provided through cone 140*a*/*b* into the clearance between the outer surface of shaft 170*a*/*b* and the inner surface of cone 140*a*/*b* from just downstream of the compression zone of the pump. Any gas that does not exit from the pump via discharge passage 144*a*/*b* can flow through passage 220 into the annular clearance inside cone 140*a*/*b* around shaft 170*a*/*b*. Just downstream from the intake zone of the pump another passage 222 is provided from this clearance through cone 140*a*/*b*. Accordingly, gas that would otherwise be carried over from the compression zone to the intake zone, where it would reduce the intake capacity of the pump, is able to bypass the intake zone and therefore does not reduce the intake capacity.

The above-described bypass gas flow is typically accompanied by a substantial flow of liquid from the liquid ring. By constructing pump 110*b* with mechanical seal 146*b* inside cone 140*b* where the mechanical seal comes in contact with this liquid flow, pump 110*b* can take advantage of that flow to cool, lubricate, flush, and otherwise enhance the performance of seal 146*b*. No external liquid supply is needed for seal 146*b*. This is an additional cost saving and operating improvement of pump 110*b* in accordance with this invention.

Similar advantages can be achieved or enhanced at the other axial end of pump 110*b*. In accordance with yet another aspect of the invention, holes 232 are provided in the annular shroud 230 at the left-hand end of rotor 180*a*/*b*. Holes 232 allow liquid from the compression side of the liquid ring to flow out into the clearance around shaft 170*b* that is partly occupied by mechanical seal 126*b*. On the intake side of the pump holes 232 allow this liquid to re-enter the liquid ring. This flow of liquid cools, lubricates, flushes, and otherwise enhances the performance of seal 126*b*. Once again, this reduces or avoids the need for an external liquid supply to seal 126*b*, with consequent cost savings and operating improvement for pump 110*b*.

Figure 3:
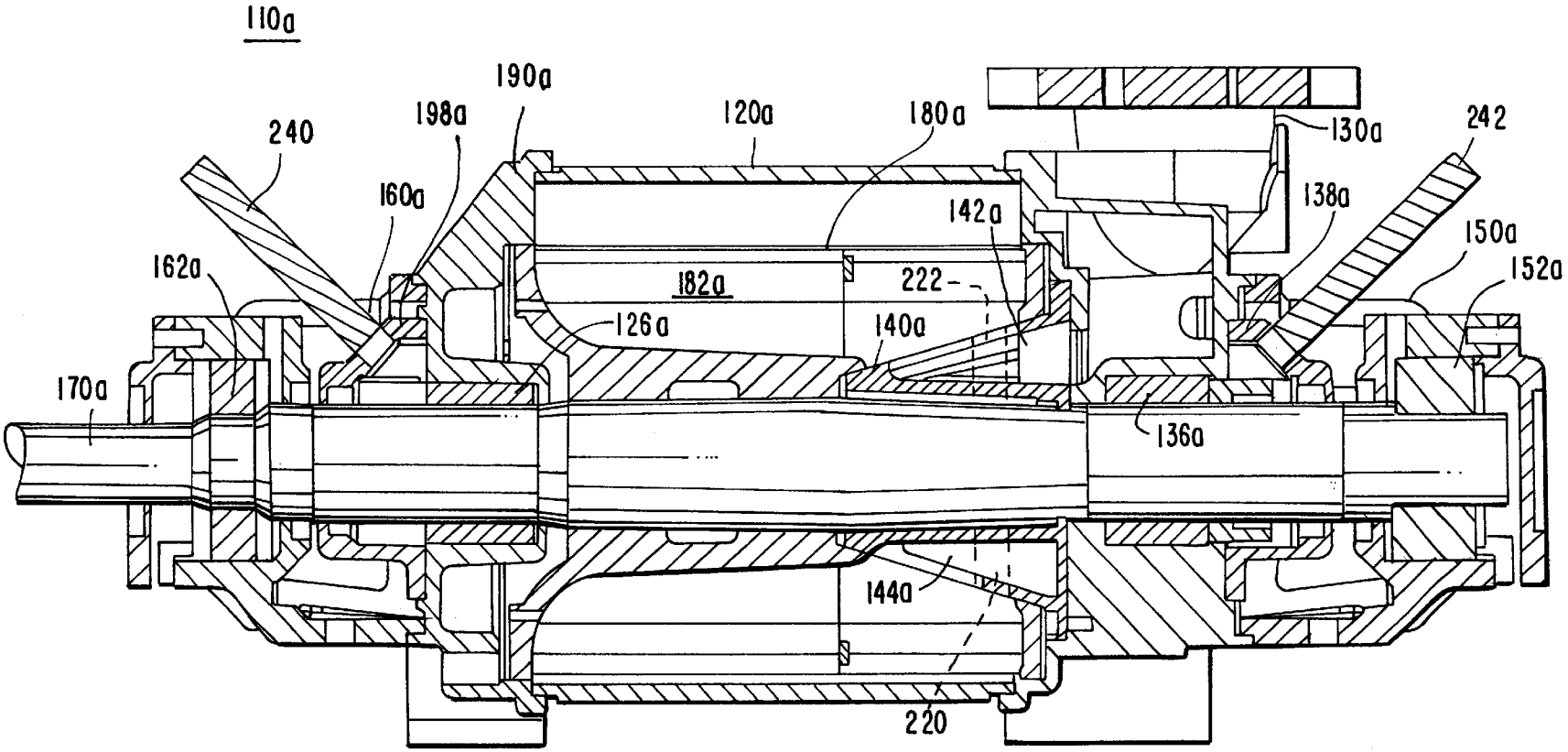
FIG. 3 is a simplified sectional view showing more of the pump shown in the upper portion of FIG. 2.
Figure 4:
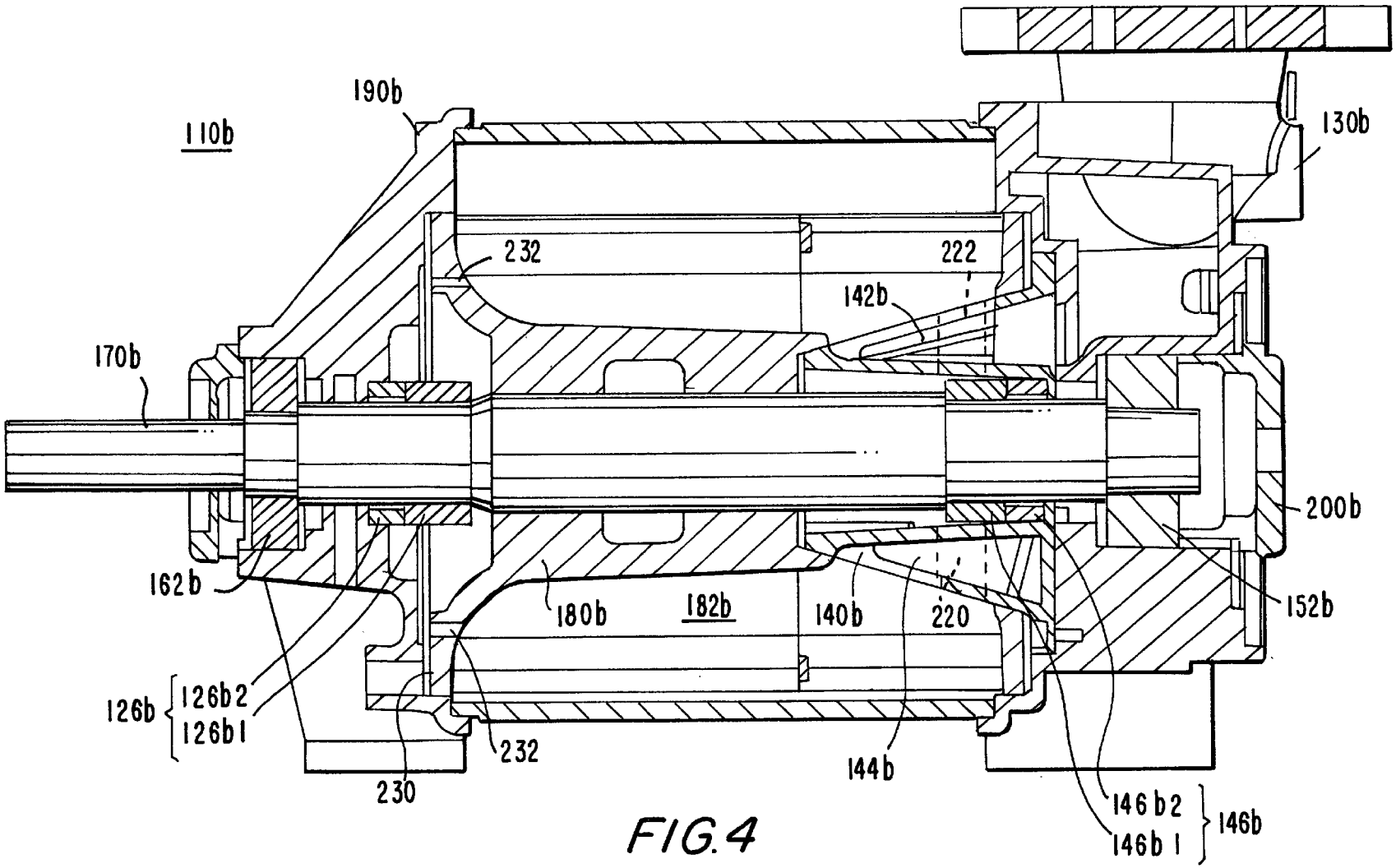
FIG. 4 is a simplified sectional view showing more of the pump shown in the lower portion of FIG. 2.

Although FIG. 2 is useful for facilitating direct comparison of pumps 110*a* and 110*b*, more of pump 110*a* is shown in FIG. 3 and more of pump 110*b* is shown in FIG. 4. In addition to what is shown in FIG. 2, FIG. 3 shows the provision of external liquid supply conduits 240 and 242 for supplying liquid to seals 126*a* and 136*a*.

FIG. 4 shows more details of particularly preferred constructions of mechanical seals 126*b* and 146*b*. In particular, FIG. 4 shows seal 126*b* constructed as a first annular component 126*b*1 mounted on shaft 170*b* for rotation therewith, and a second annular component 126*b*2 mounted on stationary end structure 190*b*. Portions of the annular, axial end faces of components 126*b*1 and 126*b*2 abut one another and thereby provide the desired mechanical seal. Liquid (e.g., from apertures 232) can reach components 126*b*1 and 126*b*2 (and especially the proximity of their abutting axial end faces) to lubricate, cool, flush, and otherwise help maintain the mechanical seal. Mechanical seal 146*b* similarly includes a first annular component 146*b*1 mounted on shaft 170*b* for rotation therewith, and a second annular component 146*b*2 mounted inside port member 140*b*. Portions of the annular, axial end faces of components 146*b*1 and 146*b*2 abut one another and thus provide a mechanical seal. Liquid (e.g., from aperture 220) can reach at least portions of components 146*b*1 and 146*b*2 (especially the proximity of their abutting axial end faces) in order to lubricate, cool, flush, and otherwise help maintain mechanical seal 146*b*.

It will be understood that the foregoing is only illustrative of the principles of the invention, and that various modifications can be made by those skilled in the art without departing from the scope and spirit of the invention. For example, although the illustrative pumps shown herein have conical (actually frustoconical) port members 140*a*/*b*, the principles of the invention are equally applicable to pumps having port members or structures with substantially cylindrical, radially outer surfaces.

What is claimed is:

1. A head member for a liquid ring pump including a hollow annular structure through which a rotor shaft of the pump will be substantially concentrically disposed for rotation relative to the head member, the hollow annular structure being configured for machining to receive either (1) a shaft having a relatively large diameter, or (2) a shaft having a relatively small diameter and an annular bearing structure which is disposed concentrically around the shaft.

2. The head member defined in claim 1 wherein the hollow annular structure remains a substantially annular structure after the machining.

3. The head member defined in claim 1 further including a gas inlet passageway which is disposed radially outside of the hollow annular structure.

4. The head member defined in claim 3 further including a gas outlet passageway which is disposed radially outside of the hollow annular structure.

5. The head member defined in claim 4 being formed as a casting prior to the machining.

6. The head member defined in claim 1 further including a gas outlet passageway which is disposed radially outside of the hollow annular structure.

7. The head member defined in claim 1 being formed as a casting prior to the machining.

8. A port member for a liquid ring pump including a substantially frustoconical outer surface and a hollow annular structure substantially concentric with and inside the outer surface and through which a rotor shaft of the pump will be substantially concentrically disposed for rotation relative to the port member, the hollow annular structure being configured for machining to receive either (1) a shaft having a relatively large diameter, or (2) a shaft having a relatively small diameter and an annular seal structure which is disposed concentrically around the shaft.

9. The port member defined in claim 8 wherein the hollow annular structure remains a substantially annular structure after the machining.

10. The port member defined in claim 8 further including:

a gas inlet passageway which is disposed radially outside of the hollow annular structure; and a gas outlet passageway which is disposed radially outside of the hollow annular structure and which is separate from the gas inlet passageway.

11. The port member defined in claim 8 being formed as a casting prior to the machining.

12. The port member defined in claim 8 wherein the hollow annular structure is further configured to provide an annular clearance between the shaft and the hollow annular structure, and wherein the port member further includes a first substantially radial passageway through the outer surface and the hollow annular structure for admitting liquid from outside the outer surface to the annular clearance, and a second substantially radial passageway through the outer surface and the hollow annular structure for passing liquid from the annular clearance to outside the outer surface.

13. The port member defined in claim 12 wherein, when the hollow annular structure receives the shaft having a relatively small diameter and the annular seal structure, the seal structure and the clearance are configured to expose at least portions of the seal structure to liquid in the clearance from the first substantially radial passageway.

14. A liquid ring pump comprising:

an annular housing;

a shaft mounted for rotation in the housing with the housing extending annularly around the shaft;

a rotor mounted on the shaft for rotation therewith, the rotor having a recess in one of its axial ends, the recess extending annularly around the shaft;

a port structure extending into the recess annularly around the shaft, the port structure being fixed relative to the housing and defining a substantially annular clearance around the shaft between an outer surface of the shaft and an inner surface of the port structure;

an annular seal structure disposed in a first portion of the clearance which is axially closer to the axial end of the rotor that has the recess; and a first aperture through the port structure configured to admit liquid from inside the housing to a second portion of the clearance which is axially farther from the axial end of the rotor that has the recess, the second portion being in fluid communication with the first portion so that the liquid in the second portion contacts at least part of the seal structure in the first portion.

15. The liquid ring pump defined in claim 14 further comprising:

a second aperture through the port structure configured to allow the liquid to flow back into the housing from the clearance.

16. The liquid ring pump defined in claim 15 wherein the second aperture extends substantially radially through the port structure.

17. The liquid ring pump defined in claim 14 wherein the first aperture extends substantially radially through the port structure.

18. The liquid ring pump defined in claim 14 wherein the seal structure comprises:

a first substantially annular component which is mounted substantially concentrically on the shaft for rotation therewith relatively far from the axial end of the rotor that has the recess;

a second substantially annular component which is mounted substantially concentrically inside the port structure relatively close to the axial end of the rotor that has the recess but with substantially annular axial end portions of the first and second components abutting one another, the first component having an inner surface which is radially spaced from the port structure so that the liquid in the second portion of the clearance can flow to the abutting end portions of the first and second components.

19. The liquid ring pump defined in claim 14 wherein the rotor includes a substantially annular shroud adjacent its axial end which is axially remote from the recess, the shroud extending radially out for partial immersion in liquid in the housing annularly all the way around the pump when the pump is in operation.

20. The liquid ring pump defined in claim 19 further comprising:

a second annular seal structure mounted substantially concentrically around the shaft beyond the axial end of the rotor which is axially remote from the recess, the shroud including a plurality of apertures spaced annularly around the shaft and configured to allow liquid from inside the housing to pass through the shroud to contact the second seal structure.

* * * * *